United States Patent [19]

Wiberg

[11] Patent Number: 4,691,449

[45] Date of Patent: Sep. 8, 1987

[54] METHOD AND APPARATUS FOR DRYING A MOIST FIBRE WEB

[76] Inventor: Per-Arne Wiberg, Gunnars Uäg 5, S-723 55 VästerÅs, Sweden

[21] Appl. No.: 775,054

[22] PCT Filed: Jan. 11, 1985

[86] PCT No.: PCT/SE85/00009

§ 371 Date: Aug. 16, 1985

§ 102(e) Date: Aug. 16, 1985

[87] PCT Pub. No.: WO85/03314

PCT Pub. Date: Aug. 1, 1985

[30] Foreign Application Priority Data

Jan. 19, 1984 [SE] Sweden ..... 8400256-7

[51] Int. Cl.[4] ..... F26B 5/16

[52] U.S. Cl. ..... 34/9; 34/111; 34/116; 34/123; 34/95

[58] Field of Search ..... 34/116, 123, 115, 41, 34/95, 9, 111

[56] References Cited

U.S. PATENT DOCUMENTS 3,925,906 12/1975 Chance et al. ..... 34/123
3,981,084 9/1976 Sobota ..... 34/123
4,112,586 9/1978 Lehtinen .
4,324,613 4/1982 Wahren .

FOREIGN PATENT DOCUMENTS 7613800-7 8/1981 Sweden .
7803672-0 4/1982 Sweden .

*Primary Examiner*—Larry I. Schwartz
*Attorney, Agent, or Firm*—Young & Thompson

[57] ABSTRACT

A method for drying a moist fibre web (6), particularly a paper web, in which the moist fibre web, subsequent to having passed a wire (9), a couch roll (10), a pick-up felt (11) and a suction press roll (8), is advanced to a press nip (13) where the fibre web is transferred to a drying cylinder (1) and remains on the cylinder until drying of the web is completed, wherein the fibre web on the drying cylinder is passed to a drying press, where a heated permeable press is pressed against the moist fibre web, whereupon moisture in the fibre web is transferred to the press by the pressure and the heat, the water pressed from the fibre web to the press being subsequently extracted therefrom with the aid of suction boxes (5, 16, 19) arranged on the inside of the press.

11 Claims, 6 Drawing Figures

METHOD AND APPARATUS FOR DRYING A MOIST FIBRE WEB

The present invention relates to a method and apparatus for consolidating a moist web of fibre structure, involving the pressing and drying of a paper-pulp web or a paper web in the manufacture of paper, for example. The novel, fundamental principle on which the invention is based resides in heating a press felt comprising heat-resistant fibres, or alternately a roll made of heat resistant material and having a permeable surface, and pressing the heated felt or the heated roll against the moist fiber web, so that moisture is pressed into the felt or the permeable surface of the roll, and is subsequently removed therefrom. Distinct from traditional fibre web drying methods, for example drying methods employed in the manufacture of paper, thermal energy for drying the fibre web is transferred from a fibrillar and/or fibrous structure to the fibre web in a press nip.

In, for example, the initial installation of paper machines, the method according to the present invention enables the traditional press and drying sections of said machines to be combined into a cheaper unit requiring less space. In the case of existing paper machines, these can be made more effective by incorporating therein apparatus and means constructed in accordance with the invention. When practising the method according to the invention considerable savings in energy can be achieved, due to the higher pressing and drying efficiencies attained, i.e. a greater amount of water can be removed from the fibre web for a given energy input.

Although the invention is described in the following mainly with reference to the drying of paper webs, it will be understood that it can also be applied in conjunction with the pressing and/or drying of other types of fibre webs, for example paper pulp webs.

In the manufacture of paper, the pressing and drying of the paper sheets constitute two functions which are extremely important for reasons of economy and with respect to paper technology. The economic aspects will now be discussed in greater detail.

The extraction of water from a fibre web by pressing the same is far more economical than extracting water by drying. This applies both to the manufacture of pulp and to the manufacture of paper. Consequently, when manufacturing paper efforts are made to press as much water as possible from the paper, without jeopardising the quality thereof. Calculations have shown that removal of water from a paper web by pressing the web is seven times more rewarding than extraction of the water by drying the web.

Drying can be said to involve two cost categories, these being investment costs and operational costs. High investment costs are primarily caused by the fact that high-production machines require long dryer sections. These are expensive to construct and also contribute to high overall construction costs.

High operational costs are mainly due to the cost of the energy required to vapourise the water remaining in the fibre web downstream of the press section. The only way in which these energy costs can be reduced when practising methods known hitherto is to raise the dry solids content of the paper web entering the drying section. The method of increasing the dry solids content of the web upstream of the drying section available in this respect is to increase the efficiencies of the press section. This has resulted in press sections in which very high demands are placed on the components incorporated therein (press felts, rolls and frame). Naturally, these demands greatly increase equipment costs. It is not thought, however, that a dry solids content in excess of 45–50% can be achieved, despite the technically advanced press sections used. This is probably due, among other things, to the phenomenon known as re-wetting. Many explanations of the re-wetting phenomenon have been put forward. One explanation proposes that: when considering a wet paper sheet, the water present is found partly in the fibres and partly in the capillaries formed between the fibres. When the sheet is pressed, the press felt will compress the fibre network of the paper. During this compression, water will flow from the paper into the fibre structure of the press felt. When this pressure is then decreased, the network of fibres in the paper will expand. As this fibre network expands, the volume of the capillaries in the sheet increases. This gives rise to a hydraulic sub-pressure. A natural consequence is that water will flow back into the sheet.

Mention has been made in the aforegoing of methods by which water can be extracted from a paper web.

There are three principal methods available by means of which energy can be transferred to the paper web for the purpose of vapourising water therein, so as to dry the same, these methods being:

(a) Drying of the paper with the aid of drying cylinders. In this case heat is transferred to the paper sheet from a hot cylindrical surface of a drying cylinder. The resultant water vapour film is evacuated between two cylinders. This method is restricted by the difficulties experienced in supplying sufficient energy to the web. Heating of the drying cylinders is practically exclusively effected with the aid of steam. Pressurised steam is permitted to condense onto the inner roll-surfaces. This results in a high heat transfer coefficient. One problem is that when wishing to increase the supply of heat, it is also necessary to increase the steam or water vapour pressure in the cylinder. For reasons of mechanical strength, this requires a cylinder of greater wall or jacket thickness, which in turn impairs the transportation of heat through the cylindrical wall of the drying cylinder. Present day drying cylinders can be said to be as good as present day cylinder-materials will allow.

Another problem associated with the transfer of heat to the paper web is one relating to the heat transfer coefficient between the cylindrical surface of the roll and the paper web. This coefficient decreases with increasing dry solids content of the sheet.

(b) A second method is one in which hot gas is blown from nozzles or jets at high velocities onto the paper web. This method is often used in combination with heated rolls. For example, in a modern soft crepe paper machine, this blow-dry method contributes to 60% of the total drying effect. The problem of supplying sufficient energy to the web is also found with this method. This is due, inter alia, because in order to break through the laminar boundary layer or intersurface adjacent the paper web, it is necessary to blow the hot gas at extremely high velocities. High blow velocities result, in turn, in high fan effects. This effect does not actually assist the supply of heat directly to the paper sheet.

(c) A third method is one referred to as the through-drying method. As the name describes, the drying gas is blown through the sheet. The method is relatively new and results in high heat transfer coefficients. In this web-drying method, the paper web is passed around a perforated roll, within which a partial vacuum or sub-pressure prevails. Hot gases are blown onto the outer-surface of the paper sheet, and the drop in pressure across the sheet causes part of the hot gas to pass therethrough. A restriction with this method is that the paper must be porous. The method also requires a high fan effect, and is primarily used to produce highly porous soft crepe paper qualities.

Various modifications of "traditional" web-press methods and web-drying methods have been described. For example, there is described in Swedish Published Specification No. 7803672-0 (Publication No. 423 118) a method and apparatus for consolidating and drying a moist porous fibre web, in which the method can be said to comprise a combined press and drying process concentrated in one and the same stage. The basic concept upon which this method is founded, is said to be one of applying heat to the outer surface of a cylinder or roll, from a heat source located externally of the cylinder or roll, instead of permitting the requisite heat to flow through the cylinder wall to the paper, as with traditional methods, and then pressing the thus heated surface under high pressure against the moist web to be consolidated. It is stated that temperatures and power densities of such high magnitudes can be used on the heated roll that steam or water vapour is generated powerfully and quickly at the boundary surface or interface between the heated roll-surface and the moist fibre web. It is said that this rapidly generated vapour is prone to seek a path from the region of high water vapour pressure, where said vapour is generated, to a region of low pressure, i.e. straight through the paper web, it being possible for the water vapour to entrain therewith any free water which might be present in cavities and voids between the fibres in the paper web. This terminating sequence in the method, i.e. that water vapour and water pass through the paper web —according to one preferred embodiment of a suction roll (2)—before it is transferred to the heated roll (1) constitutes a principle difference viz-a-viz the method according to the present invention, as will become apparent from the following detailed description of the invention.

Another method which forms part of the prior art is found described in Swedish Published Specification No. 7613800-7 (publication number 419661). The method, which is based on the suction-drying principle, relates to the drying of a paperboard or paper web, in which the paper web placed on a drying belt, e.g. a drying felt, is passed between two movable airtight surface members of good thermal conductivity. One of the surface members (1) in contact with the web is heated while the other of said surface members (2) in contact with the drying belt (4) is cooled, in order to condense water evapourated from the web into the belt. Water is subsequently removed from the cold drying belt by suction. The method is not therefore a combined press and drying method, but is based on a different principle to the present invention.

As beforementioned, the present invention relates to a combined press and drying method for wet, porous fibre webs, for example a paper web. The object of the method according to the invention is to overcome the problem of re-wetting of the web during the pressing process and the problem of heat transfer during the drying process, these problems being prevalent in methods used hitherto.

As previously mentioned in the introduction, the novel principle according to the invention can be applied in accordance with two alternative embodiments, wherewith in accordance with the first embodiment a heated felt comprising heat-resistant fibres is pressed against the wet fibre web to be de-watered, while in accordance with the second embodiment the felt is replaced with a heated, permeable roll.

The first embodiment is illustrated schematically in FIG. 1, and is described hereinafter with reference to this figure.

Figure 1:
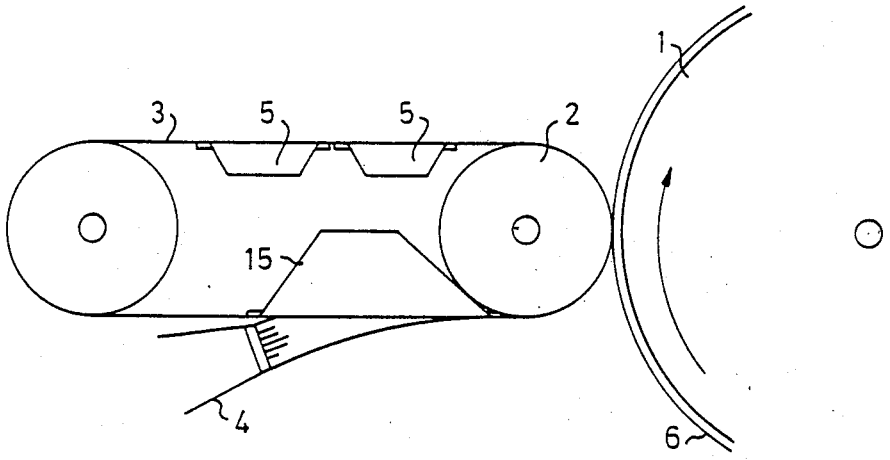
FIG. 1 is a schematic elevational view of a first embodiment of apparatus for drying a moist fibre web according to the present invention.

The apparatus illustrated in FIG. 1 includes a drying cylinder 1, to which the moist fibre web downstream of a traditional couch roll is conducted in a conventional manner per se by a pick-up felt, up to a first conventional press nip. These components are again referred to hereinafter with reference to FIG. 3, which illustrates the apparatus according to the invention incorporated in its context together with the aforesaid known part-arrangements. Referring again to FIG. 1, there is shown a felt 3 made of heat-resistant fibres pressed against the drying cylinder by means of a press roll 2, which together with a further roll and the felt form a felt loop, as illustrated in the figure. The outer surface of the felt is heated externally, for example by means of a hot combustion gas deriving from a gas burner 4 and drawn through the felt by suction. The heated felt is pressed against the moist fibre web 6 in the press nip, whereupon moisture is pressed from the fibre web into the press felt.

Subsequent to having passed the press nip, the press is de-watered with the aid of suction boxes 5 arranged adjacent the inner surface of the felt, or in some other conventional manner. Any fibre material adhering to the felt subsequent to its passage through the press nip can be removed therefrom by suitable devices, not shown. Conceivable means in this respect include, for example, spraying the felt externally with a powerful water jet, upstream of the suction boxes, or by directing a powerful stream of air against the felt upstream and/or downstream of the suction boxes, optionally in combination with brushes.

When the felt passes into the press nip, the surface fibres of the felt are heated to high temperatures. The maximum temperature capable of being reached and used is dependent, inter alia, on the fibre material used in the felt. If water cannot be extracted from the felt to the extent desired in a single press nip, one or more additional press nips of the same kind can be used against one and the same drying cylinder. This embodiment will be described in more detail hereinafter with reference to FIG. 3.

As a result of the moisture gradient prevailing in the felt, the temperature of the heated felt rapidly falls at some distance into the felt. When the hot surface fibres are pressed against the fibre sheet, an extremely high heat transfer is obtained between felt and fibre sheet. Water vapour or steam is generated very strongly around the fibres in the felt. The water vapour stream entrains therewith water which has not vapourised. This water is heated by felt and cylinder and is consequently more fluid than cold water, which increases the transportation of water.

The supply of heat to the felt is controlled so that the vapourisation process continues in the centre of the nip. A large number of microscopic vapour bubbles are then found around the fibres of the felt in the nip centre. As hereinbefore described, the sheet expands downstream of the nip centre and gives rise to a hydraulic sub-pressure in the sheet.

As opposed to a conventional press, the minute vapour bubbles here constitute an effective barrier to re-wetting. The water vapour bubbles cause the sub-pressure to be held at an extremely low level. When the sub-pressure attempts to increase, the volume of the vapour bubbles also increases.

The water vapour pressed into the felt will condense when it meets the colder fibres located within the felt. In this respect, there is formed in the felt a moisture gradient which contributes to cooling the internal fibres of the felt while heating the outer layers of the felt. This is a desired effect, which results in the internal fibres of the felt being subjected to less thermal stress.

The object of the described method according to the invention is to introduce energy (heat) into the fibre web, e.g. the paper web, in a manner which is more effective than was previously the case. The efficiency of the method is based on the following: when the hot flue gases are drawn through the press felt a small-scale turbulence is created which results in a high heat-transfer coefficient between the gas and the felt. A comparison can be made in this respect with a rotor-type heat exchanger.

When the hot felt is pressed against the paper web an extremely high heat transfer takes place, due to the high contact pressure and the "fine-mesh" structure of the felt. This structure imparts to the felt fibres a large heat-transfer area in relation to the water volume. The high contact pressure causes a major part of the water volume to be pressed into the outer layer of the felt and to embrace the hot felt fibres. The method also enables the press sequence to be carried out more effectively. Two reasons can be given for this:

(a) The heavy vapour flow during the press sequence entrains water present in the felt. Thus, it is not necessary for this water to be vapourised in order to remove it from the paper.

(b) The microscopic vapour bubbles eliminate re-wetting of the sheet in an effective manner. These properties of the process are of extremely high significance with regard to economy, due to the fact that they considerably reduce the amount of energy consumed.

The efficiency of the method according to the first embodiment of the invention, i.e. in which a heatable felt is used, is highly dependent upon the fibre material used in the felt. In principle, any fibre material which fulfils the following two requirements can be used :

heat resistance.

The fibres should be capable of withstanding flue-gas temperatures, which may reach to about 600°–1000° C. The fibres should also be able to withstand rapid cooling in the press nip.

Elasticity.

The fibres shall be capable of distributing the pressure in the press nip, and must therefore fulfil certain requirements with regard to elasticity. A further requirement which must be fulfilled by the felt fibres is that they must withstand the needling process in manufacture.

Figure 2:
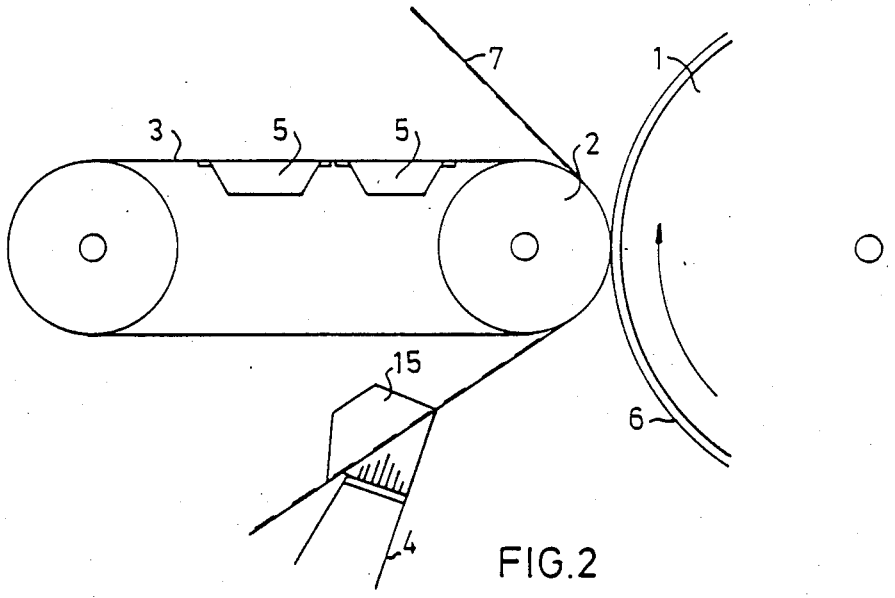
FIG. 2 is a view similar to FIG. 1 but showing a modification thereof.

According to one modification of the embodiment employing heated fibre felt the heated surface fibres of the felt are replaced with a permeable, heat-resistant band 7 as illustrated in FIG. 2. The band, or belt, is heated upstream of the press nip with the aid, for example, of a gas flame, induction heat or superheated steam (300°–500° C.). According to this embodiment the press nip comprises the press roll 2, encircled by a felt loop as described above, and by the hot band 2, the paper web 6, and a hard roll 1, which carries the sheet. The band 7 is thin and need not be de-watered downstream of the press nip. The water extracted from the web is found in the felt downstream of the press nip, and is extracted from the felt with the aid of suction boxes 5.

Figure 3:
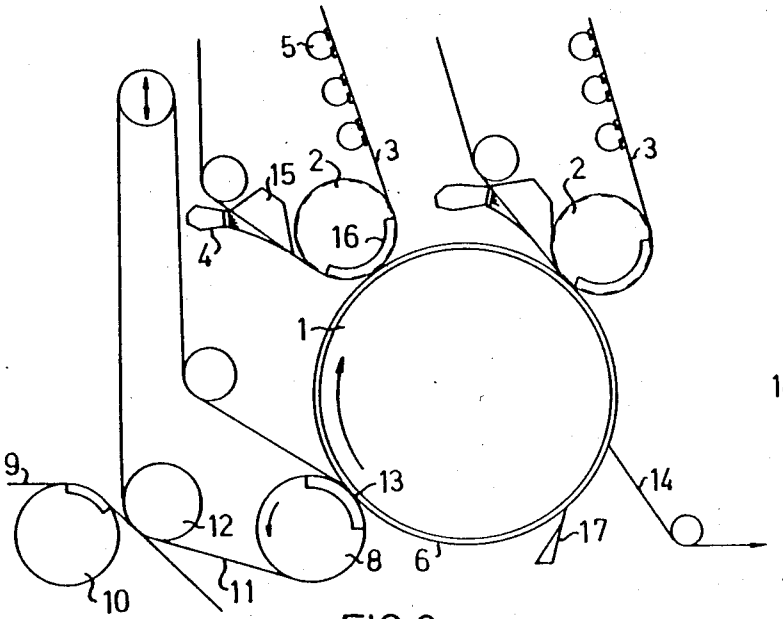
FIG. 3 illustrates apparatus as shown in FIG. 1, but in its overall combination with known structure.

FIG. 3 illustrates an application of the embodiment according to the invention using a heated felt in a machine array including, inter alia, a conventional press nip comprising a press roll 8 and, in the illustrated case, two press nips according to the invention, each of said nips comprising a press roll 2 and a fibre felt 3 heated with the aid of a gas burner 4.

The paper web arrives from the forming unit via a wire 9 to a couch roll 10, where the dry solids content of the web is increased. A pick-up felt 11 is pressed lightly against the fibre web at 12, whereafter the web follows the felt. The suction press roll 8 urges the paper web 6 against the drying cylinder 1 in the press nip 13, whereby a major part of the total de-watering process takes place in the press nip. The dry solids content of the sheet downstream of the first press nip, which is of conventional kind, is in the order of about 35%. The web guiding means and rolls located in the section extending from the wire 9 to a location downstream of the first press nip 13 are of a kind conventionally found in the manufacture of soft crepe paper.

Downstream of the first press nip, the paper web is firmly pressed on the drying cylinder 1, and does not leave the cylinder until the sheet has been finally dried, with the exception that an additional drying cylinder with associated press nip according to the invention can be provided when necessary.

That the machine, in respect of the most important embodiment employing only one drying cylinder, lacks so-called free draw can be considered highly advantageous since it radically reduces the risk of web fractures, therewith increasing the useful time of the machine, which in turn is of the utmost economic importance.

Downstream of the location at which the paper web is pressed onto the drying cylinder there are arranged two drying presses of the kind according to the invention, each comprising a press cylinder 2, optionally provided with suction boxes, and a press-felt 3 of the aforedescribed kind, heated with the aid of a gas burner 4. The gas burner of this embodiment, may be replaced with some other heating means and one or both of the presses according to the invention can be replaced with the function of pressing in accordance with FIG. 2, incorporating a heatable permeable band 7.

Downstream of the last press nip, the dried paper web is drawn from the drying cylinder at 14, and is passed to an optional smoothing machine and reeling machine.

In the described and illustrated machine array, the wire 9 and the couch roll 10 are of a traditional kind, and the pick-up felt 11 and suction-press roll 8 are of the kind used in the manufacture of soft crepe paper.

Each of the heatable fibre felts 3 is associated with suction boxes 15, the purpose of which is to draw the hot burner gases through the felt. The suction boxes are suitably provided with ceramic strips, in order to withstand temperature and wear. The suction boxes are also divided into sections arranged to be placed under vacuum individually, namely so as to be able to control the supply of energy at mutually different locations, transversely to the machine. This provides a splendid tool for controlling the moisture content of the web in its transverse direction.

The purpose of suction boxes 5 is to extract the water pressed into the felt. The transport of water in the press felt should take place in a direction in which the dry fibres located in the outer layer of the felt—against the paper—are not wetted prior to heating.

The permeable press rolls 2 are suitably suction rolls, where the inner suction box 16 for example has the extension illustrated in the figure, this extension being such as to counteract water in the felt being thrown to the surface thereof. The linear pressure is established in test runs.

The drying cylinder 1 has, for example, a diameter of about 2.5 m and is thus something inbetween a conventional drying cylinder and a Yankee cylinder.

The cylinder may be steam heated in a conventional manner.

The drying cylinder may be provided with for example, doctors 17 or brushes, intended for cleaning the cylinder.

As beforementioned, in the machine array of FIG. 3, the first press downstream of the pick-up felt 11 is of traditional kind. Its function is to increase the dry solids content sufficiently to prevent the paper sheet from being shredded by the powerful generation of steam or water vapour in the subsequent hot press nip.

Press No. 2 is a hot press according to the invention. The sheet is dried in this press to a final dry solids content, or slightly therebeneath.

Press No. 3 is applied in the machine array when the sheet is not dried to a final dry solids content in press 2. The difference between press 2 and press 3 is that the felt is heated to a much lower temperature in press 3, namely for the purpose of eliminating the risk of overdrying the sheet to an extent such as to destroy the same.

A plurality of hot presses can be placed around the drying cylinder when necessary and to the extent that available space permits. These presses are not shown in the figure, however.

Figure 4:
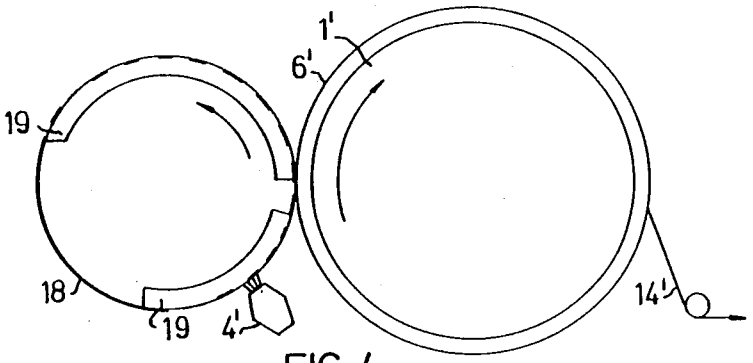
FIG. 4 shows another embodiment of the invention.

According to the second principal embodiment of the invention, which is based on the same drying principle as the embodiment just described incorporating a heated pressed felt, the felt loop including the roll and felt is replaced with a roll 18 having a permeable surface, as illustrated in FIG. 4. Since this roll surface, which is a perforated metal surface, is hard and rigid as opposed to the felt surface according to the first embodiment, the drying cylinder 1' in this case is suitably for example, a rubber-lined roll.

The surface of the roll 18 is heated either with a gas flame 4 or, alternatively, by induction heat upstream of the press nip. The paper —or fibre web 6—is constantly located on the rubber-lined roll 1'. In other respects, the pressing sequence is similar to that described with reference to the press-felt embodiment. Water is pressed into the cavities of the roll 18, under partial vapourisation of the water, and is removed by suction on the innersurface of the cylindrical wall of the roll by means of suction boxes 19.

Figure 5:
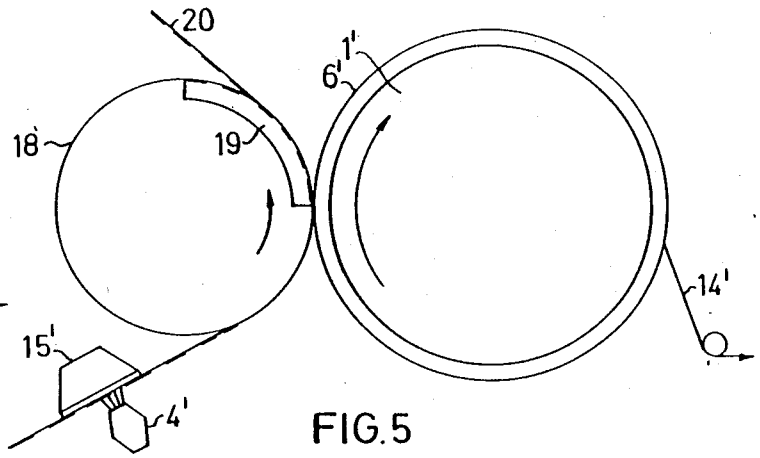
FIG. 5 shows still another embodiment thereof.

According to one particular embodiment of the invention, the permeable roll surface of the roll 18 is provided with a perforated metal band 20. This band may constantly accompany the roll surface, or as illustrated in FIG. 5 may deviate from said surface. In both instances it is the metal band which is heated instead of the roll surface, and in this regard the principal is the same as that in the FIG. 2 embodiment.

When considering the economic advantages afforded by the novel method in comparison with, for example, the conventional manufacture of paper in conventional paper machines, the following facts should be taken into account: the drying section of a paper machine takes up the largest amount of space. Furthermore, the drying section is responsible for a greater part of the cost of the machine, both directly and indirectly. Direct costs are related to construction and manufacturing costs. The indirect costs are related to buildings, foundations and maintenance. In reality the drying method according to the present invention enables all drying to be carried out in the press section of the machine, thereby enabling the traditional drying section to be eliminated, since it is now incorporated in the press section.

As beforementioned, the paper is dried without the occurrence of free draws in a machine. This means that the sheet is seated on a support surface during the whole of the process, enabling the machine to be utilised to a higher degree. The degree of utilisation is of extreme importance, due to the large investments made in the production line as a whole, in which the paper machine can be a bottle-neck.

A further advantage afforded by the method according to the invention is that less energy is consumed than in conventional drying sections. This is based on the fact that when compared with drying methods known hitherto more water is transferred into the felt, or the roll of the alternative embodiment, without being vapourised.

Finally, the construction and manufacturing costs for a machine equipped with drying equipment according to the invention should not be appreciably higher than the cost of a conventional machine excluding the drying section. This assessment is based on the fact that the machine components, with the exception of the felt or the permeable roll, are of a tested kind from various applications.

There is today a great need for equipment which will increase the drying capacity of existing machines. There is a large number of machines at present with which the drying section constitutes the limiting section of the machine. These machines are often placed in small buildings which make it impossible to extend the drying section. The drying arrangement or means according to the invention is well suited for such machines.

A test simulating the drying/pressing method according to the invention

The test was carried out for the purpose of verifying the effect afforded by the present invention. In this respect, the time sequence of the press nip was simulated with the aid of a slightly modified although known and used apparatus of the hammer type. The apparatus is used, for example, in the Svenska Traforskningsinsitutet, Stockholm, (Swedish Forest Products Research Laboratory) for instruction and research.

Figure 6:
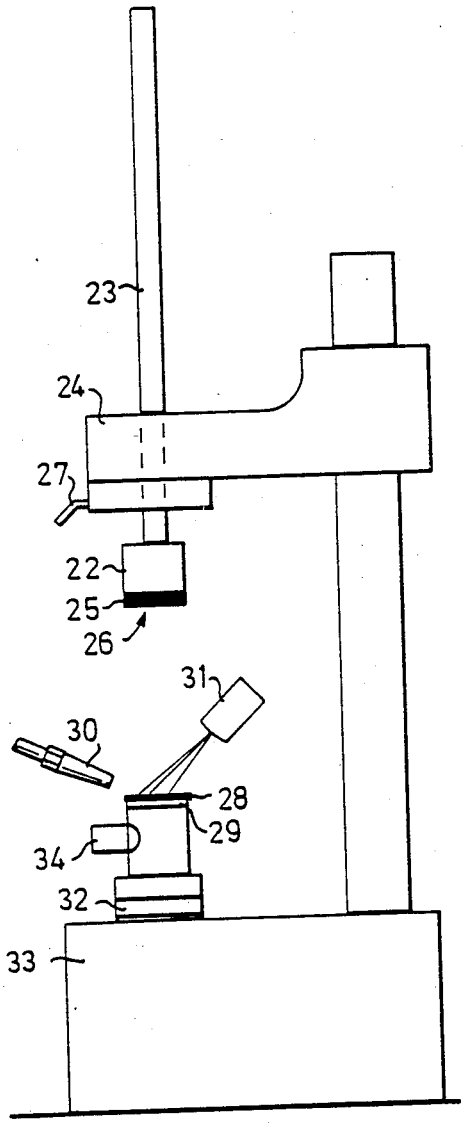
FIG. 6 is an elevational view of test equipment for verifying the results produced by the present invention.

An explanatory sketch of the apparatus used is shown in FIG. 6.

The apparatus comprises a weight 22 which is attached to a rod 23 running in a slide bearing 24. The weight has a rubber plate 25 and a paper sheet 26 to be tested attached to said plate. In operation, a release means 27 causes the weight 22 to fall onto a sintered-metal plate 28 lying above a further, perforated plate 29.

The sintered-metal plate 28 can be heated with the aid of a gas burner 30, and the temperature of the plate can be measured with the aid of an out-of-contact thermometer 31.

Of the other reference numerals in the figure, the reference 32 identifies a force sensor, reference 33 identifies a support means, and reference 34 identifies a fan for removing combusion gas.

In the test, the sintered-metal plate simulates the press felt 3 or the heated permeable roll 18 according to the invention.

In the tests, a sheet of newsprint having an initial weight prior to the test of 0.85 g and an ingoing dry solids content of 18% was subjected to two drop tests, which thus simulated two press nips of the kind according to the invention, at a sintered-metal plate temperature of 20° and 200° C. respectively and a contact time of $2\times1.7$ ms. Subsequent hereto it was found that the sheet had a weight of 0.26 g and a dry solids content of 57%. After the drop test, the absolute dry weight of the sheet was measured and found to be 0.15 g. In a reference test using an unheated felt (37° C.) instead of the sintered-metal plate, a paper sheet which prior to the drop test had a weight of 0.72 g and a dry solids content of 20% was found to weigh 0.44 g after a single drop test which simulated a press nip-time of 1.5 ms. Departing from the dry weight of 0.15 g determined after the drop test, this gives a dry solids content after the drop test of 34%.

The test shows that, when compared with an unheated felt, high dry solids contents are obtained even when heating to relatively low temperatures (about 200° C.), which tends to confirm the effect which is expected to be attained in practise when applying the method according to the invention.

I claim:

1. In a method for drying a moist fiber web (6), in which the web downstream of a forming unit is taken up on a wire (9) and advanced to a press nip (13) via a couch roll (10), a pick-up felt (11) and a suction press roll (8), and the fiber web is transferred in the press nip (13) to the periphery of a drying cylinder (1); the improvement comprising carrying the web on the outer cylindrical surface of said cylinder to a drying press, and in the drying press pressing against the moist fiber web (6) a permeable press means at a temperature above 100° C. and including a press roll (2, 18) so that water is extracted from the fiber web and enters the permeable press means, extracting said water from the press means with the aid of suction boxes (5, 16, 19) within said press means, retaining the fiber web (6) from which water has been extracted on the drying cylinder (1) downstream of the press nip of said press means, and then removing the dried web from the drying cylinder.

2. A method as claimed in claim 1, in which the press means includes a felt loop comprising a press roll (2), a press felt (3) comprising heat resistant fibers, suction boxes (5) and further rolls, heating the press felt upstream of the press nip with the drying cylinder (1) above 100° C., and then pressing the heated felt against the moist fiber web (6) thereby to press moisture into the felt, and extracting moisture from the felt downstream of the press nip with the aid of said suction boxes (5).

3. A method as claimed in claim 2, in which said press roll (2) also has suction boxes (16).

4. A method as claimed in claim 2, and freeing the press felt (3) downstream of the press nip from any fiber material adhering thereto.

5. A method as claimed in claim 1, in which the press means comprises a felt loop and there is arranged externally of the press felt (3) in the press nip against the drying cylinder (1) and thus in direct contact with the fiber web (6) a permeable heat resistant band (7), heating said band with a gas flame, pressing water partly in vapor form through perforations in the metal band and into the press felt, and thereafter removing water from the press felt by said suction boxes (5).

6. A method as claimed in claim 1, in which said press means comprises a permeable metal roll (18) and the drying cylinder (1') comprises a roll having an elastic outer cylindrical surface, heating directly by means of a gas burner (4') the press roll (18) upstream of the press nip against the moist fiber web (6') on the drying cylinder, and pressing water in the fiber web in the press nip into perforations in the outer cylindrical surface of the roll and removing this water from the inner surface of the cylindrical surface by means of suction boxes (19).

7. A method as claimed in claim 6, and freeing the surface of the roll (18) downstream of the roll nip from any fiber material adhering thereto.

8. A method as claimed in claim 1, in which the press means includes a permeable metal roll (18) and drying cylinder (1') and wherein there is arranged externally of the metal cylindrical surface of the roll (18) in the press nip against the fiber web and thus in direct contact therewith a permeable heat resistant metal band (20), and heating said metal band upstream of the press nip, whereby the press nip water, partially in vapor form, is pressed through the perforations of the metal band and into the voids or cavities of the roll surface, when said water is removed on the outside of the outer cylindrical surface of the roll with the aid of suction boxes (19).

9. In a drying arrangement for a moist fiber web, comprising a drying cylinder (1) over which the web passes, and heatable permeable press means adapted to be pressed against the moist fiber web to take up water therefrom; the improvement in which the press means comprises a felt loop including a pair of rolls, of which one roll (2) is a press roll, and a press felt (3) comprising heat resistant fibers and extending over said roll pair, and heating means for heating the outer surface of the press felt, a suction box (15) located inwardly of the press felt and arranged to draw combustion gases through the felt by suction, and suction boxes (5) located inwardly of the press felt downstream of the press nip for removing by suction water which has been pressed into the felt upon contact of the press felt with the moist fiber web (6) in the press nip.

10. A drying arrangement as claimed in claim 9, and a heat resistant, heatable permeable band (7) which is located in the press nip against the fiber web externally of the press felt (3), and means for heating said band and then for pressing into direct contact with the moist fiber web (6) the heated band.

11. A drying arrangement as claimed in claim 9, including means for freeing the press felt from any fiber residues adhering to said felt downstream of the press nip.

* * * * *